US011098976B2

(12) United States Patent
Call

(10) Patent No.: US 11,098,976 B2
(45) Date of Patent: Aug. 24, 2021

(54) AIRGUN PROJECTILE CARRIER

(71) Applicant: Crosman Corporation, Bloomfield, NY (US)

(72) Inventor: Kenneth A. Call, Rush, NY (US)

(73) Assignee: Crosman Corporation, Bloomfield, NY (US)

( * ) Notice: Subject to any disclaimer, the term of this patent is extended or adjusted under 35 U.S.C. 154(b) by 0 days.

(21) Appl. No.: 16/794,038

(22) Filed: Feb. 18, 2020

(65) Prior Publication Data

US 2020/0263950 A1 Aug. 20, 2020

Related U.S. Application Data

(60) Provisional application No. 62/808,289, filed on Feb. 20, 2019.

(51) Int. Cl.
*F41B 11/54* (2013.01)

(52) U.S. Cl.
CPC ..... *F41B 11/54* (2013.01)

(58) Field of Classification Search
CPC ..... F41B 11/50; F41B 11/54
USPC ..... 124/48
See application file for complete search history.

(56) References Cited

U.S. PATENT DOCUMENTS 3,782,359 A * 1/1974 Kester ..... F41B 11/62 124/48
3,913,553 A * 10/1975 Braughler ..... F41B 11/54 124/73
4,422,433 A * 12/1983 Milliman ..... F41B 11/54 124/44.7
4,986,251 A * 1/1991 Lilley ..... F41B 11/54 124/48
5,150,701 A * 9/1992 Wackrow ..... F41B 11/57 124/67

(Continued)

FOREIGN PATENT DOCUMENTS

CN 105403101 3/2016
CN 105674798 6/2016

(Continued)

OTHER PUBLICATIONS

PCT Search Report and Written Opinion dated Oct. 22, 2020 for PCT Application No. PCT/US20/18769, 12 pages.

(Continued)

*Primary Examiner* — Alexander R Niconovich
(74) *Attorney, Agent, or Firm* — Lee & Hayes, P.C.

(57) ABSTRACT

Projectile carriers are provided. In one aspect, a projectile carrier has a storage area with a breech opening and a bolt opening aligned with the breech opening along a first axis, a plurality of projectile drivers positioned in the storage area are biased to move in a first direction within the storage area along a path that passes between the breech opening and the bore opening. A stop is positioned to stop movement of the projectile drivers in the first direction when one of the projectile drivers is positioned substantially aligned at the first axis. The projectile drivers have a block that prevents a projectile from exiting the bolt opening. The projectile drivers are sized and can be moved in a second direction to allow a bolt to drive a projectile along the first axis through the breech opening.

14 Claims, 15 Drawing Sheets

(56) References Cited

U.S. PATENT DOCUMENTS

| | | | | |
|---|---|---|---|---|
| 6,470,871 | B2 * | 10/2002 | Casas-Salva | F41B 11/54 124/48 |
| 7,159,584 | B2 * | 1/2007 | Maeda | F41A 9/73 124/41.1 |
| 9,134,090 | B1 * | 9/2015 | Park | F41B 11/55 |
| 10,066,896 | B2 * | 9/2018 | Zhu | F41B 11/54 |

FOREIGN PATENT DOCUMENTS

| | | |
|---|---|---|
| GB | 2152646 | 8/1985 |
| GB | 2484536 | 4/2012 |

OTHER PUBLICATIONS

PCT Invitation to Pay Additional Fees dated Aug. 4, 2020 for PCT Application No. PCT/US20/18769, 2 pages.

* cited by examiner

AIRGUN PROJECTILE CARRIER

CROSS REFERENCE TO RELATED APPLICATIONS

The present disclosure claims priority to U.S. Provisional Patent Application No. 62/808,289, filed Feb. 20, 2019, which is incorporated herein by reference.

STATEMENT REGARDING FEDERALLY SPONSORED RESEARCH OR DEVELOPMENT

N/A

BACKGROUND

The need for reliable air gun magazines to permit rapid reloading is longstanding. EP 0341,090A2 provides one example of such an airgun magazine as known in the prior art. This example is shown in FIG. 1. As is shown in FIG. 1, and as is described in the '092 abstract, this example of an airgun comprises an outer case 1, a circular pellet carrier 2 rotatably mounted in the outer case 1, and a cover 3 that is pivotally mounted on the outer case 1 and pellet carrier 2. A coil spring 4 resiliently biases the pellet carrier 2 towards an end position. To load magazine, the cover 3 is pivoted to cause the pellet carrier 2 to rotate to another end position, and a soft lead airgun pellet is then dropped in through a hole in the outer cover 3 into a pellet chamber 21 in the pellet carrier 2. The outer cover 3 is then rotated, allowing successive pellets to be dropped into successive pellet chambers within the pellet carrier 2. A fastener 5 joins cover 3, circular pellet carries coil spring 4 to outer case 1. In use, a probe pushes the first pellet out of the magazine into the breach of an airgun, is then retracted, and following this, the magazine automatically indexes under pressure from spring 4 until the pellet contacts a stop 11 to present the next pellet ready for loading. The pellets themselves serve as part of the indexing mechanism. The transfer probe places the pellets accurately in position within the breech of the airgun.

Similarly, the 10X Quick-Shot Magazine sold by Gamo Outdoor USA, Rogers, Ar., USA, provides a magazine with a circular pellet carrier with individual pellets held in separate tubes. The circular pellet carrier is rotated by a bias into a position where the projectiles are not aligned with openings of the tube. When a bolt is advanced into the tube, the pellet the bolt strikes a deflection surface rotating the circular pellet carrier into alignment with the bolt aligned with the bolt and breach for loading. This system therefore relies on the interaction between the circular pellet carrier and the bolt to achieve proper positioning of the pellet relative to the breech.

In such a magazine, the pellet is effectively clamped between pellet carrier 2 and stop 11 until the pellet is moved into the breech. However, airgun pellets and other airgun projectiles are frequently made from or using at least in part materials that will inelastically deform when exposed to a significant clamping force. To prevent such problems, the spring pressure provided by a coil spring 4 in a magazine of this type is typically limited. This, however, creates a situation where the clamping force against the pellet can be lost temporarily when the magazine is exposed shock, vibration or other accelerations. When this occurs, it becomes possible for the pellet to move through the opening provided for the probe to enter the magazine. This creates the possibility of jams. Such a possibility is particularly acute where such magazines are used with break barrel type weapons which can experience significant accelerations urging a pellet in such a direction.

Accordingly, what is needed is a carrier for airgun projectiles and an airgun and system that can hold an airgun projectile within a magazine even when exposed to significant accelerations, without deforming the projectile and while enabling bolt action in cooperation with the projectile carrier.

Additionally, airgun magazines such as the Crosman Model RC2210 Magazine sold by Crosman Corporation, Rochester, N.Y., USA have usefully incorporated a clear rear cover on a side of the magazine that allows a user to see inside the magazine to determine for example the number of rounds remaining. Typically, this clear cover is positioned on a bolt side of the magazine so that a user of the air gun can observe the number of rounds remaining without removing the magazine. In addition, this clear clover can be useful in loading projectiles into such a magazine. However, it is most useful when the user can likewise load projectiles from the bolt side of the magazine. Accordingly, what is also needed is the ability to load projectiles through the load projectiles into the carrier from a bolt side of the projectile carrier while preventing backward movement of the projectiles.

SUMMARY OF THE INVENTION

Projectile carriers are provided. In one aspect, a projectile carrier has a storage area with a breech opening and a bolt opening aligned with the breech opening along a first axis, a plurality of projectile drivers positioned in the storage area are biased to move in a first direction within the storage area along a path that passes between the breech opening and the bore opening. A stop is positioned to stop movement of the projectile drivers in the first direction when one of the projectile drivers positions a projectile substantially aligned with the first axis. The projectile drivers further comprise a block located between the projectile and the bolt opening with the block extending toward the stop so that a separation between the block and the stop is less than a size necessary for the projectile to move from the projectile holder through the bolt opening and wherein the projectile driver has a separation offset sized to permit movement of the projectile carrier in a second direction along the path sufficient permit a bolt to enter the projectile driver without moving the projectile from the position determined by the stop.

DETAILED DESCRIPTION OF THE INVENTION

Figure 1:
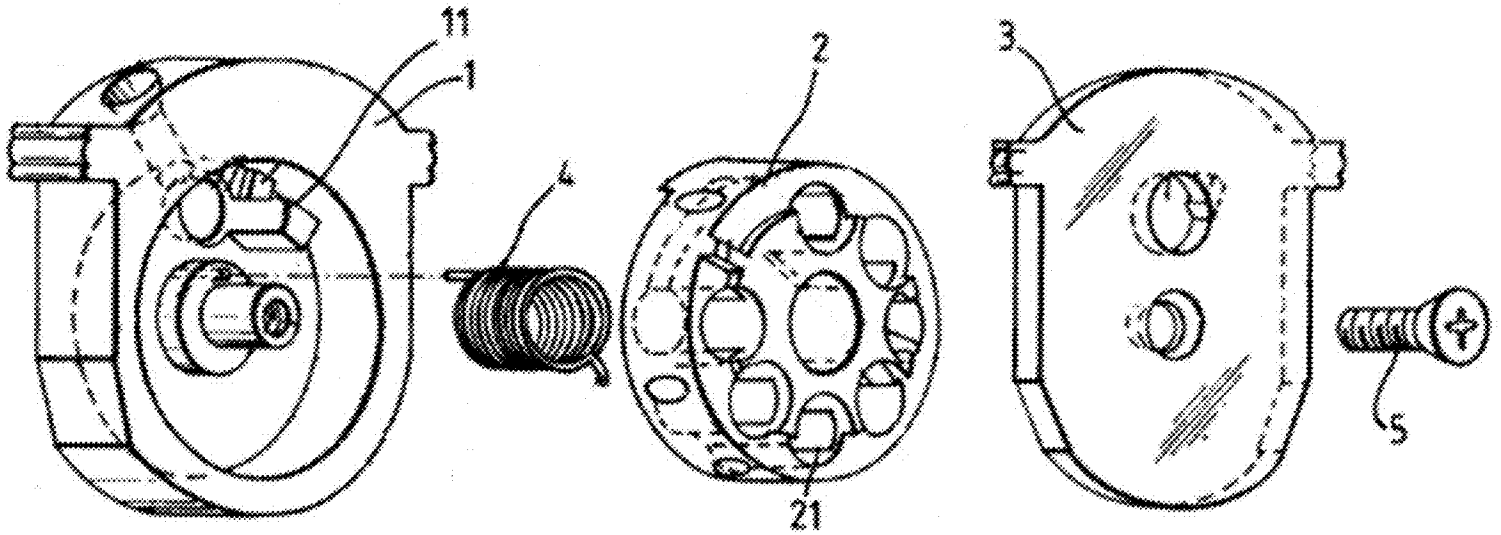
FIG. 1 (PRIOR ART)
FIG. 1 shows an airgun magazine of the prior art.
Figure 2:
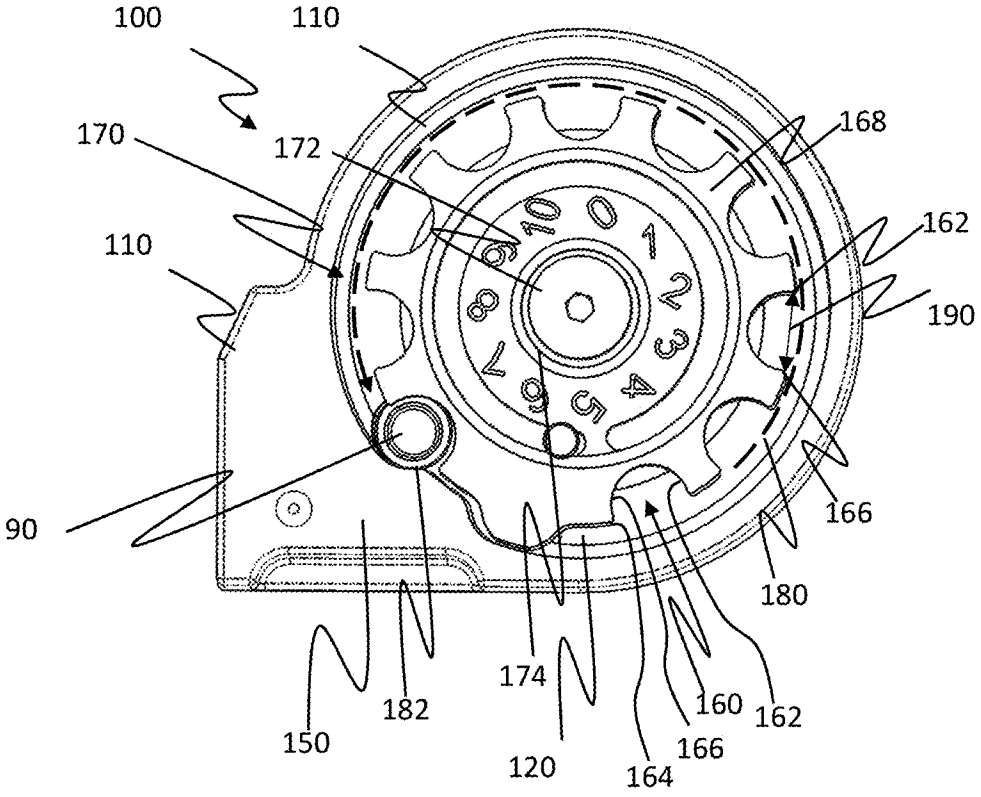
FIG. 2 shows a rear elevation view of one embodiment of a projectile carrier with a projectile therein and prior to assembly of a bolt wall to the projectile carrier.
Figure 3:
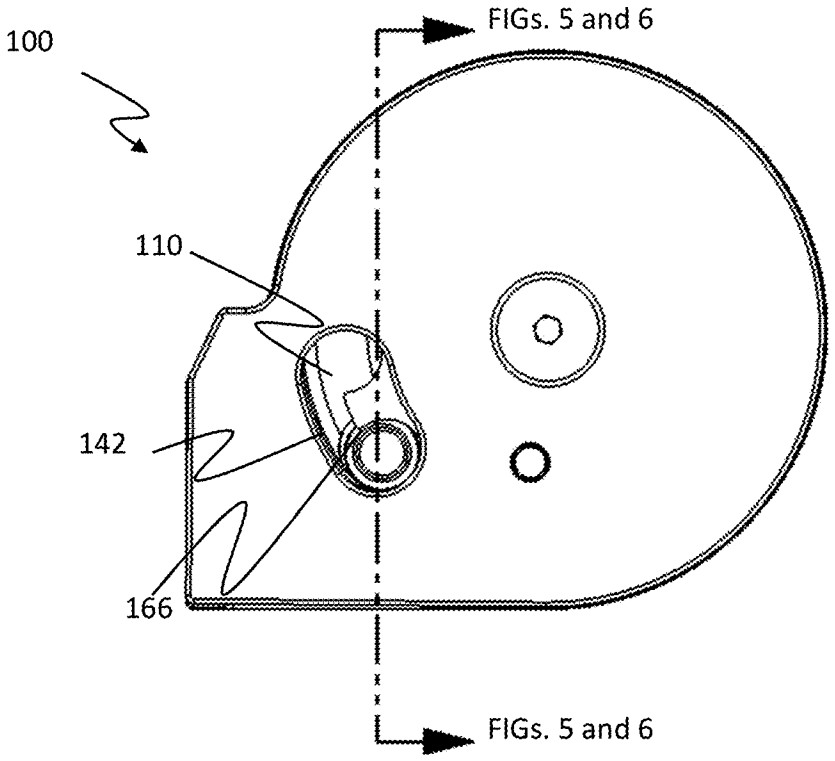
FIG. 3 shows a front elevation view of the embodiment of FIG. 2 with one embodiment of a bolt wall mounted thereto.
Figure 4:
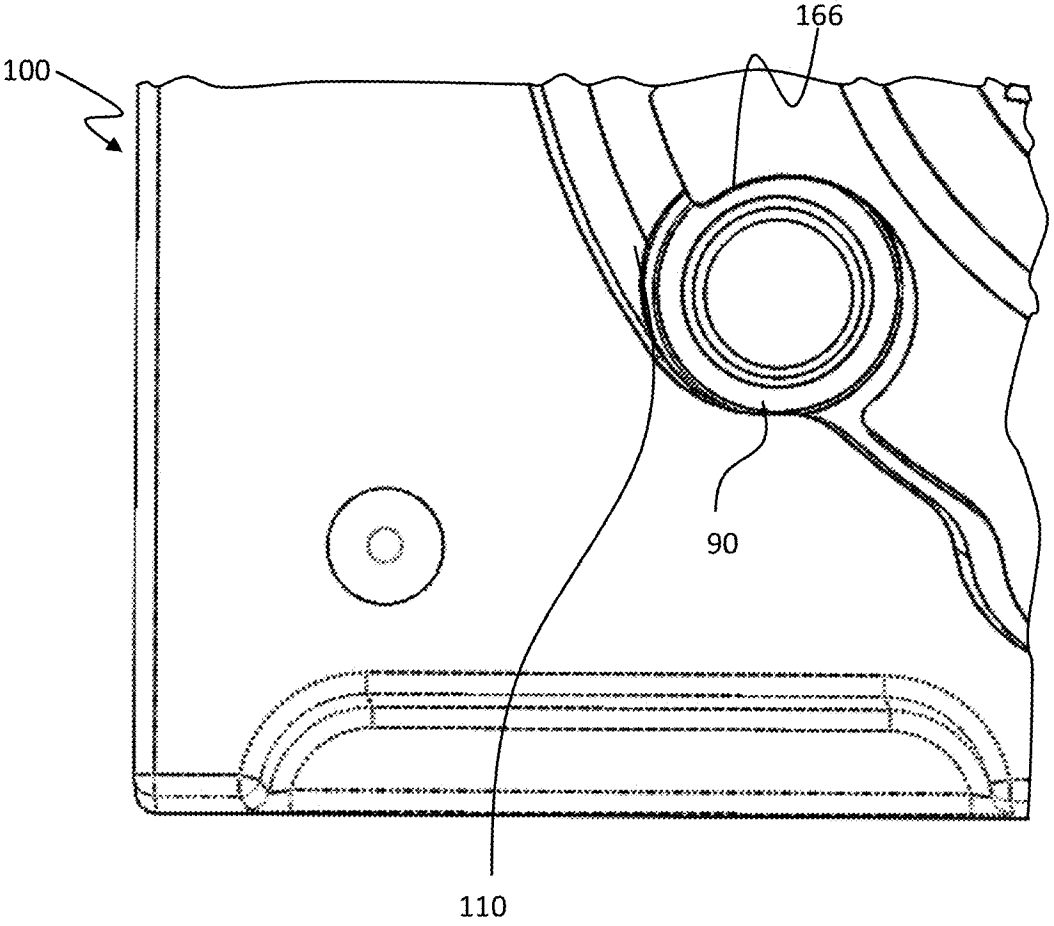
FIG. 4 shows an enlarged cut-away view of the embodiment of FIGS. 2 and 3 with a projectile and a bolt wall.
Figure 5:
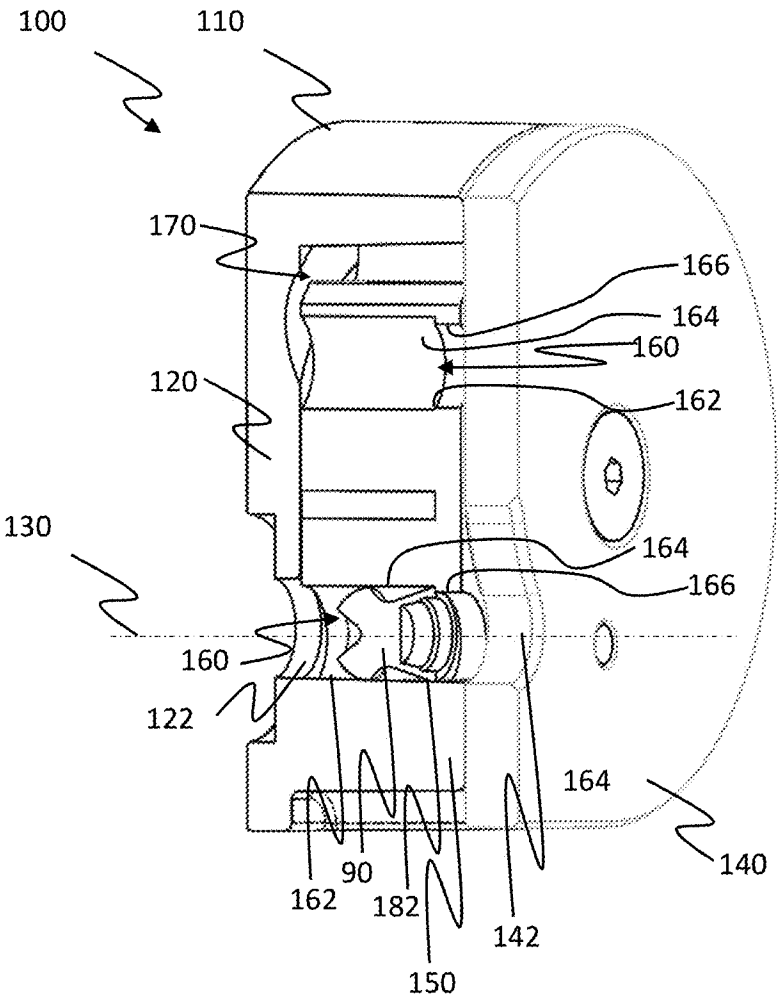
FIG. 5 shows a left, top, back perspective view of the embodiment of FIGS. 2 and 3 sectioned as indicated in FIG. 3.
Figure 6:
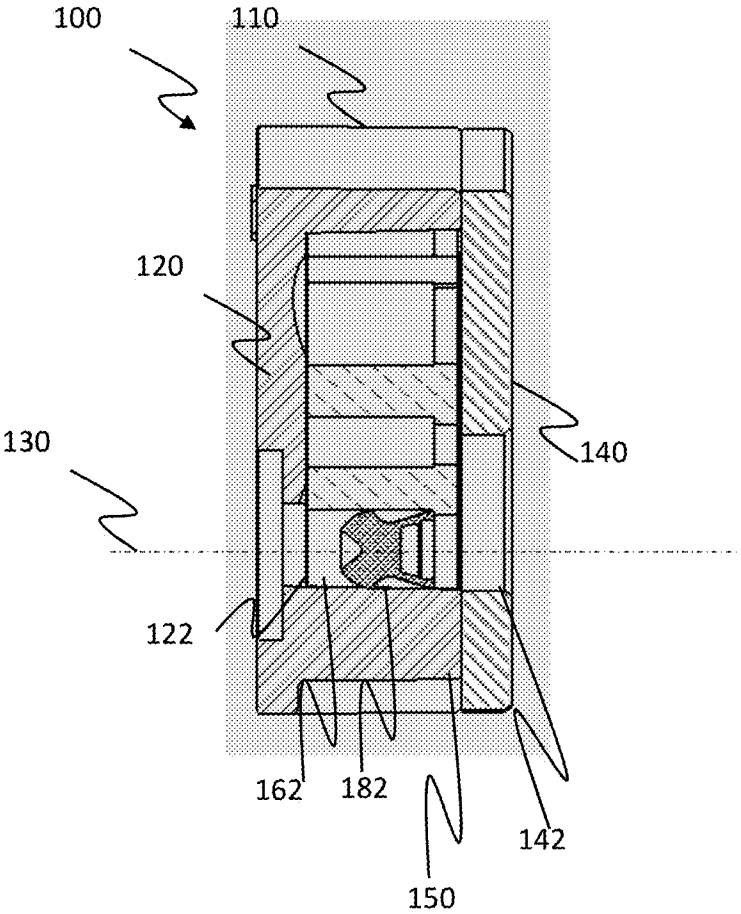
FIG. 6 shows a left side elevation and cross-section of the embodiment of FIGS. 2 and 3 sectioned as indicated in FIG. 3.

FIG. 2 shows a rear elevation view of one embodiment of a projectile carrier 100. In FIG. 2, a detachable bolt wall is not shown. FIG. 3 shows a front elevation view of the embodiment of FIG. 2 with the bolt wall attached, FIG. 4 shows an enlarged cut-away view of the embodiment of FIG. 2 with a projectile and FIG. 5 shows a left, top, back perspective view of the embodiment of FIG. 2 sectioned as indicated in FIG. 3 and FIG. 6 is a cross section left side elevation of the embodiment of FIG. 2 taken as illustrated in FIG. 3. As shown in FIGS. 2-6, projectile carrier 100 has a frame 110 with a breech wall 120 having a breech opening 122 through which a projectile 90 can pass along a first axis 130; a bolt wall 140 having a bolt opening 142 at least in part aligned with breech opening 122 along the first axis and through which the projectile 90 can pass. A storage wall 150 contains projectiles along axes that are not parallel to first axis 130 and provides a path between breech opening 122 and bolt opening 142.

In this embodiment, a plurality of projectile drivers 160 are provided in a storage area 170 contained by breech wall 120, bolt wall 140 and storage wall 150. Each projectile driver has a leading surface 162 separated from a trailing surface 164 to define a space therebetween within which at least a portion of a projectile 90 can be positioned. Projectile drivers 160 are movable within storage area 170 to advance a projectile 90 therein along a path 180. In this embodiment, projectile drivers 160 are provided on a carousel 168 that rotates along an axis generally aligned with an axis of screw 172. This rotation of projectile drivers 160 brings trailing surfaces 164 into contact with any projectile 90 located in the respective projectile driver and urges projectile 90 to move such that path 180 is generally circular. A biasing member 174 stores energy during a pellet loading process and releases this energy to urge rotation of carousel 168. Here, biasing member 174 takes the form of a coil spring that urges rotating carousel 168 to move projectile drivers 160 in a first direction to advance projectiles 90 along path 180.

A stop 182 is positioned to block movement of a projectile 90 along path 180 when projectile 90 is substantially aligned with breech opening 122 and bolt opening 142.

As is shown in FIGS. 1-6, a block 166 extends from a position proximate trailing surface 164 and toward leading surface 162 such that a separation between block 166 and stop 182 is less than a size of the projectile when projectile 90 is positioned against stop 182. This creates a barrier against to movement of projectile 90 through bolt opening 142 when projectile carrier 100 is exposed to shock. It will be appreciated that block 166 prevents such movement without requiring an increase in the amount of clamping force applied against projectile 90 by trailing surface 164.

However, it must still be possible for a bolt of an airgun to pass through bolt opening 142, and bolt passageway 190 to drive projectile 90 through breech opening 122. Accordingly, in this embodiment, block 166 is separated from leading surface 162 to create a bolt passageway 190 that is substantially similar in size to that of projectile 90 but offset from the first axis 130 when trailing surface 164 urges projectile 90 against stop 182.

Figure 7:
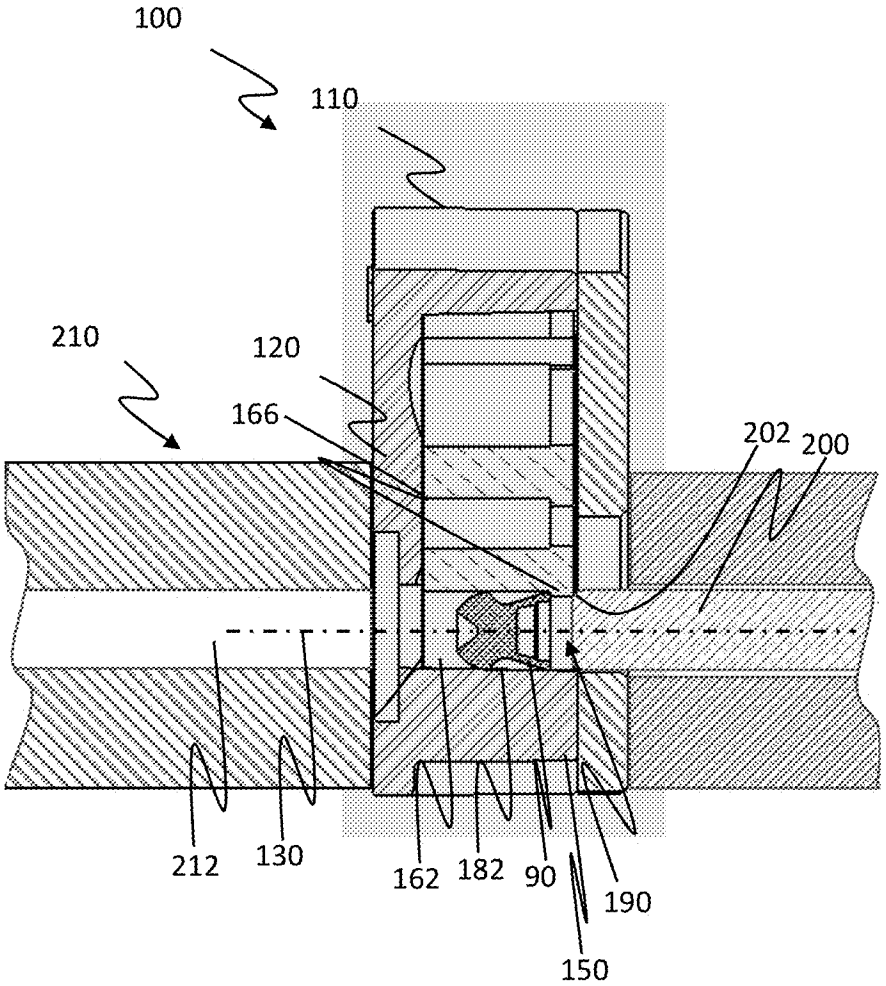
FIG. 7 shows a portion of an air rifle having a bolt and a breech shown here as an end of a barrel with a projectile positioner therein and a bolt reaching a point of contact with the projectile positioner.
Figure 8:
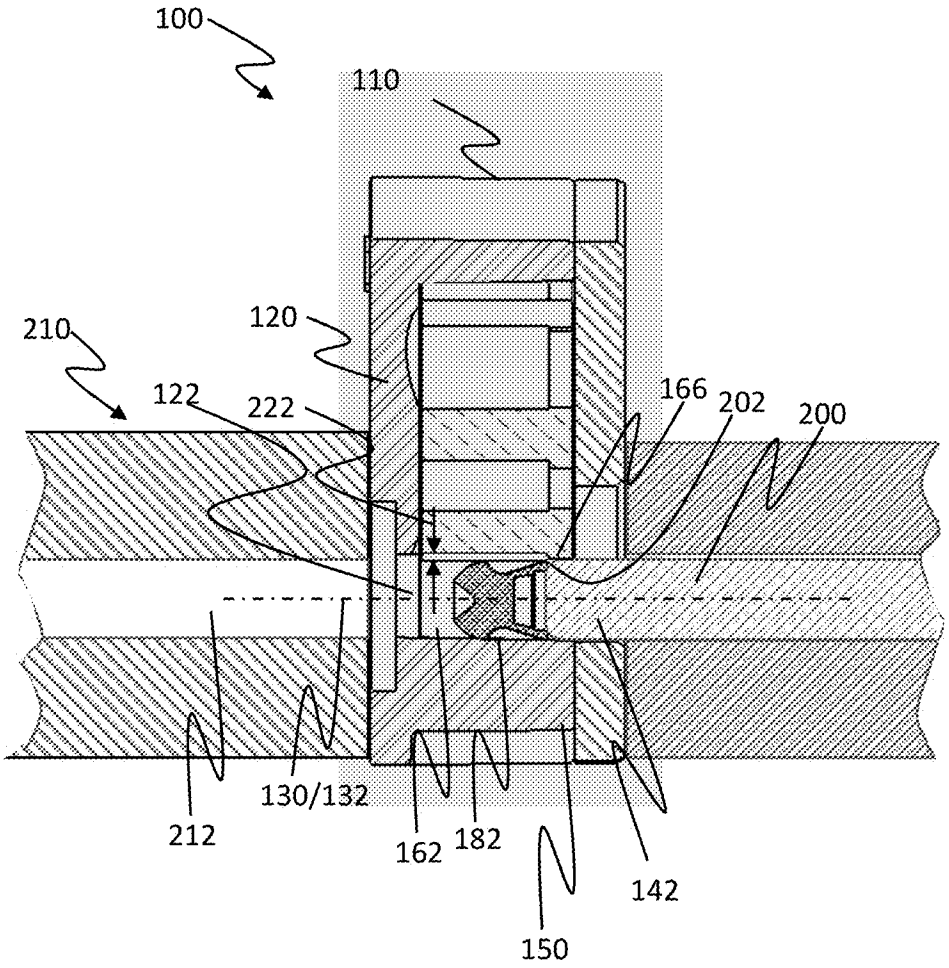
FIG. 8 shows the portion of the air rifle and w portion of an air rifle having a bolt and a breech shown here as an end of a barrel with a projectile positioner therein and a bolt having contacted the projectile positioner to move the projectile positioner.

FIG. 7 shows a cut away cross-section portion of an air rifle having a bolt 200 and a breech 210 shown here as an end of a barrel 212. As is seen in FIG. 7, as bolt 200 advances along first axis 130, block 166 interferes with the path of travel of bolt 200. Here, bolt 200 is shown with a tapered lead in surface 202 shaped so that the force applied by bolt 200 as bolt 200 advances along first axis 130 is directed to urge projectile positioner 160 to move in a direction opposite the first direction along path 180 to move bolt passageway 190 such that bolt 200 can advance generally along first axis 130 to advance projectile 90 into breech 210 as is illustrated in FIG. 8 which shows the cut away cross section portion of the air rifle of FIG. 7 with bolt 200 having deflected projectile holder 100. Also shown in FIG. 8, is an extent of a separation offset 222 between stop 166 and leading surface 162. It will be appreciated that in this way, projectile 90 remains positioned by stop despite movement of projectile carrier 120 in the second direction so that the position of projectile 90 relative to breach opening 122 and barrel 122 is determined based upon the location of stop 182 irrespective of the movement of projectile drivers 160 in the second direction It will be appreciated that to enable such an outcome, leading surface 162 must be separated from trailing surface 164 by a distance that is at least greater than an extent to which block 166 extends away from trailing surface 164 when a projectile 90 is positioned therebetween.

Figure 9:
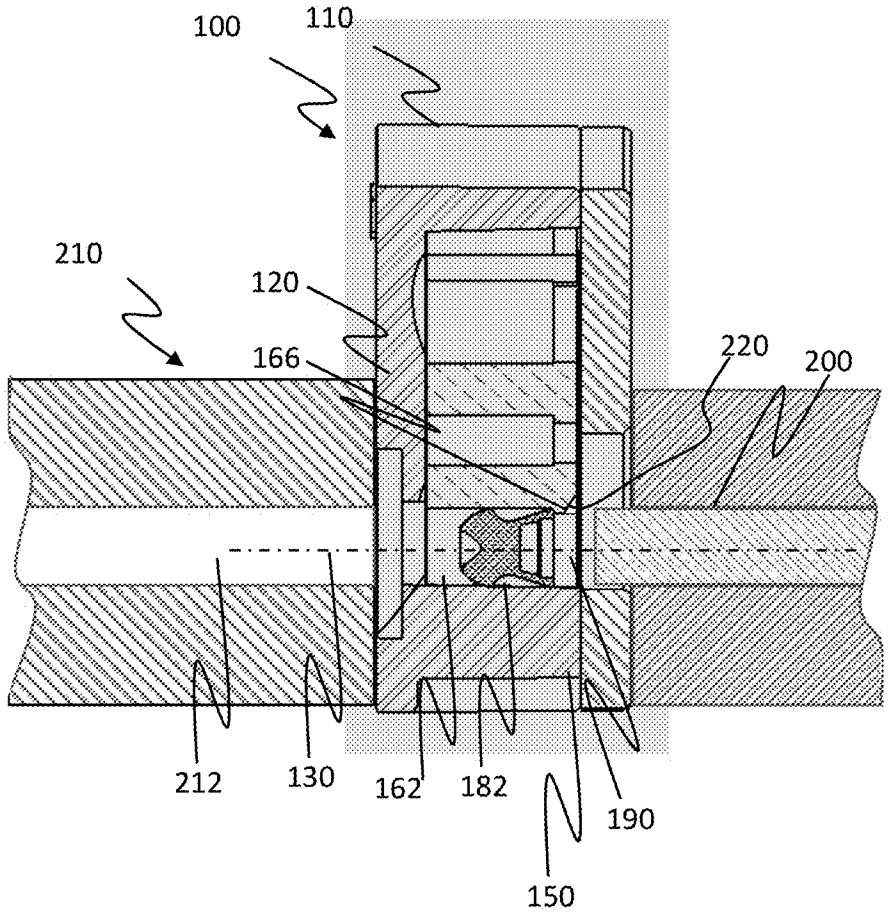
FIG. 9 shows an alternative embodiment of the projectile positioner with a deflection surface.

As is shown in FIG. 9, in other embodiments, a lead in surface 220 may be provided on block 166 to cause a force from bolt 200 to deflect block 166 and projectile positioner 160 to position bolt passageway 190 so that bolt 200 can advance generally along first axis 130 to engage and drive projectile 90 through breech opening 122.

Figure 10:
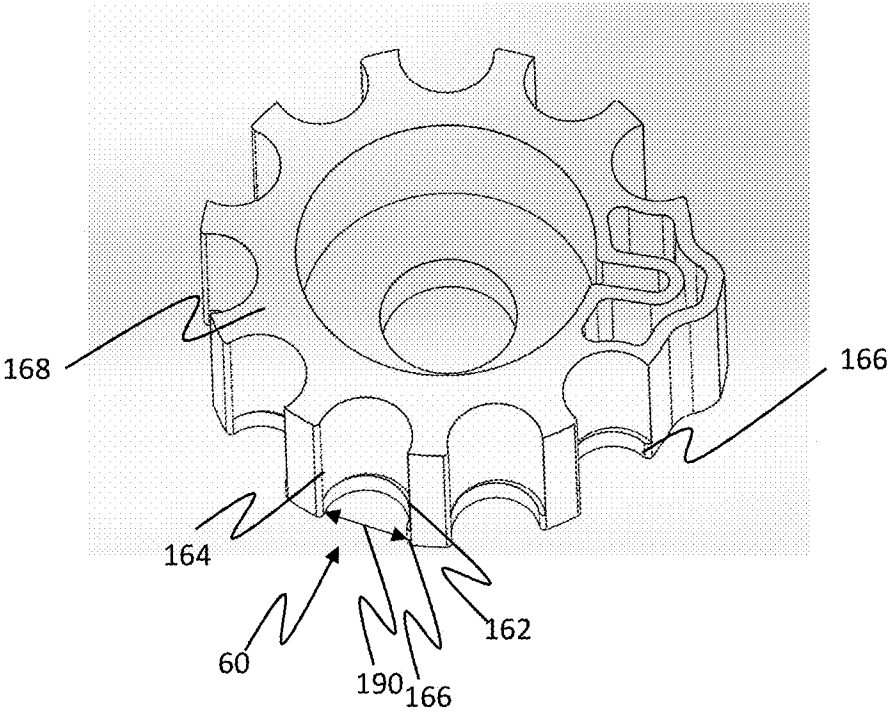
FIG. 10 shows an enlarged view of carousel and projectile positioners of the embodiment of FIGS. 2 and 3.

FIG. 10 shows an enlarged view of carousel 168 and projectile positioners 160 of the embodiment of FIG. 2. As can be seen in FIG. 10, in this embodiment block 166 takes an arcuate shape that tapers axially from a maximum thickness at trailing surface 164 to a surface that is aligned with leading surface 162 Also shown in FIG. 10 is another view of the bolt passageway 190 of this embodiment.

Figure 11:
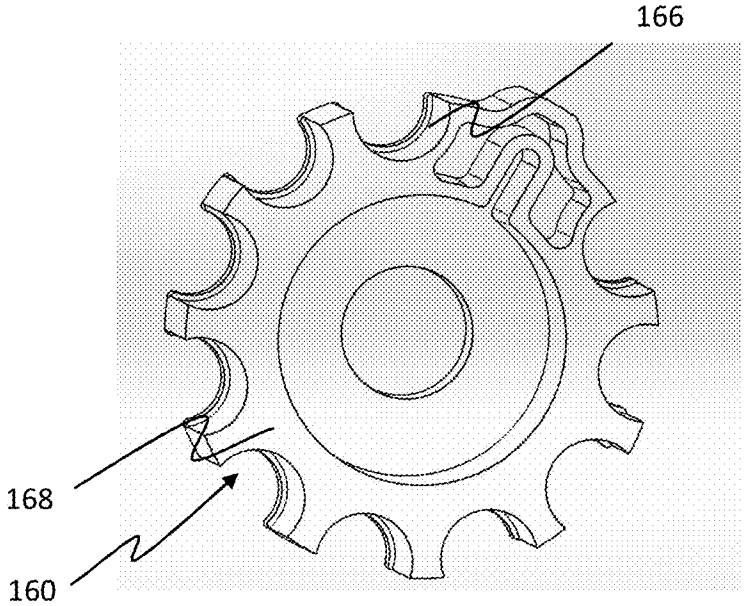
FIG. 11 shows an enlarged view of an alternative embodiment of a carousel and projectile positioners.

FIG. 11 shows an enlarged view of an alternative embodiment of a carousel and projectile positioners. In this embodiment, block 166 takes the form of a semi-circular block of generally equal thickness.

Figure 12:
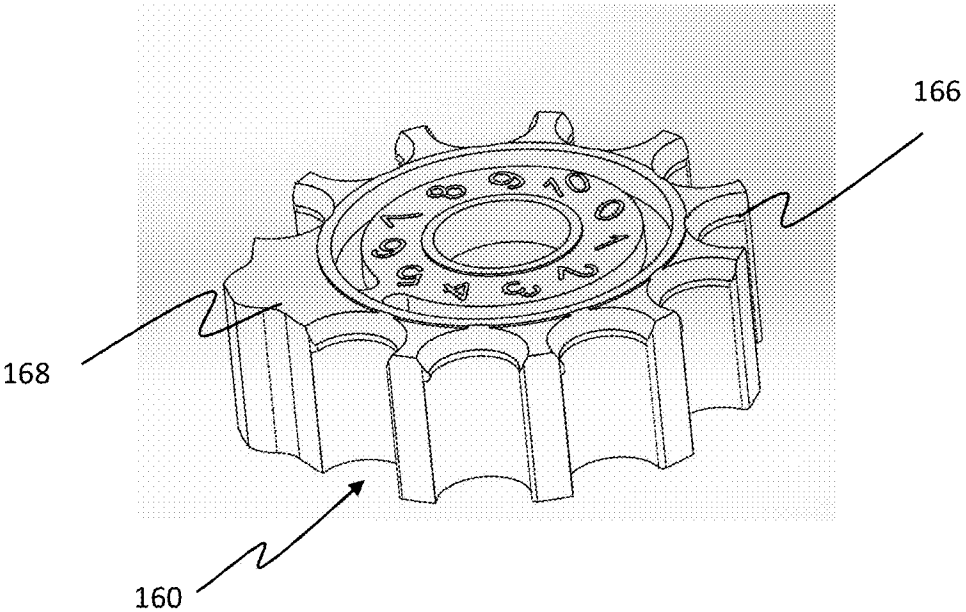
FIG. 12 shows an enlarged view of an alternative embodiment of a carousel and projectile positioners.

FIG. 12 shows an enlarged view of an alternative embodiment of a carousel 168 and projectile positioners 160, having a tapered edge that extends along a surface of carousel 168 and into block 166 to help redirect an axially applied force to drive carousel and projectile positioners in a second direction along the path.

Figure 13:
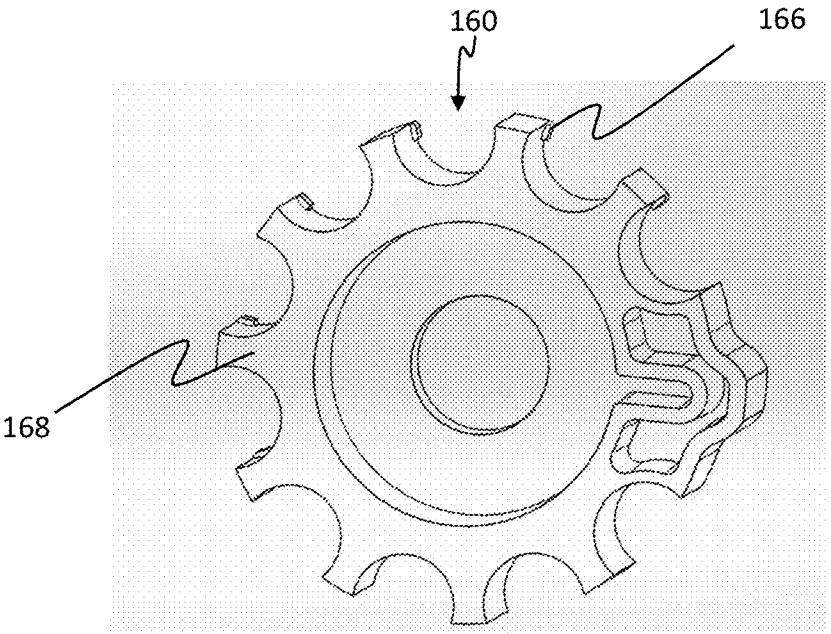
FIG. 13 shows an enlarged view of an alternative embodiment of a carousel and projectile positioners.

FIG. 13 shows an enlarged view of an alternative embodiment of a carousel 168 and projectile positioners 160 using a smaller configuration for block 166. As is evident in FIG. 13, in this embodiment, block 166 extends over less than 20 percent of a perimeter of projectile driver 160 and thus a projectile (not shown in FIG. 13) held by a projectile driver 160.

Figure 14:
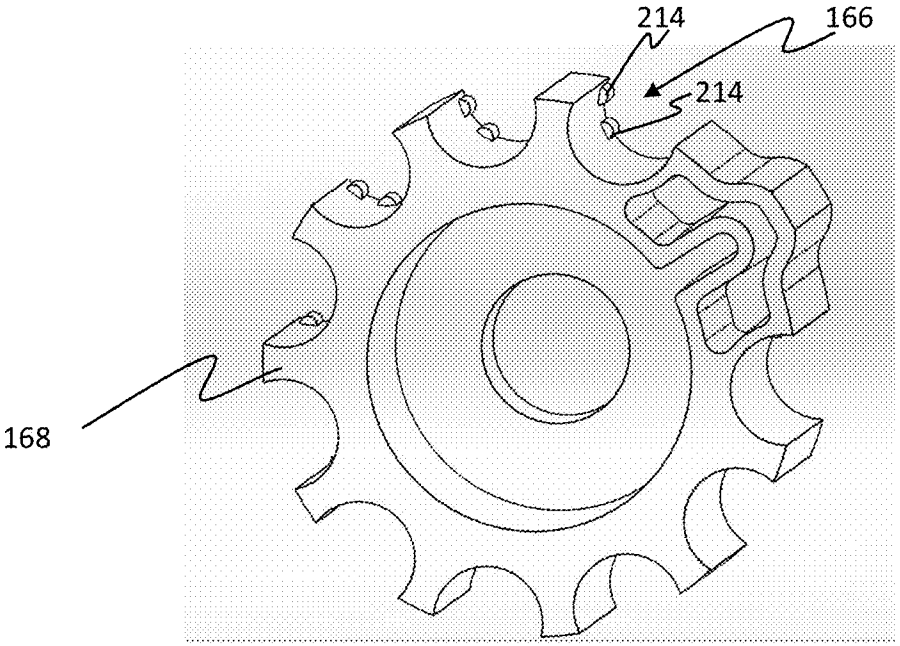
FIG. 14 shows enlarged view of an alternative embodiment of a carousel and projectile positioners.

FIG. 14 shows enlarged view of an alternative embodiment of a carousel 168 and projectile positioners 160 using configuration of block 166 having multiple node 220 and 222

Figure 15:
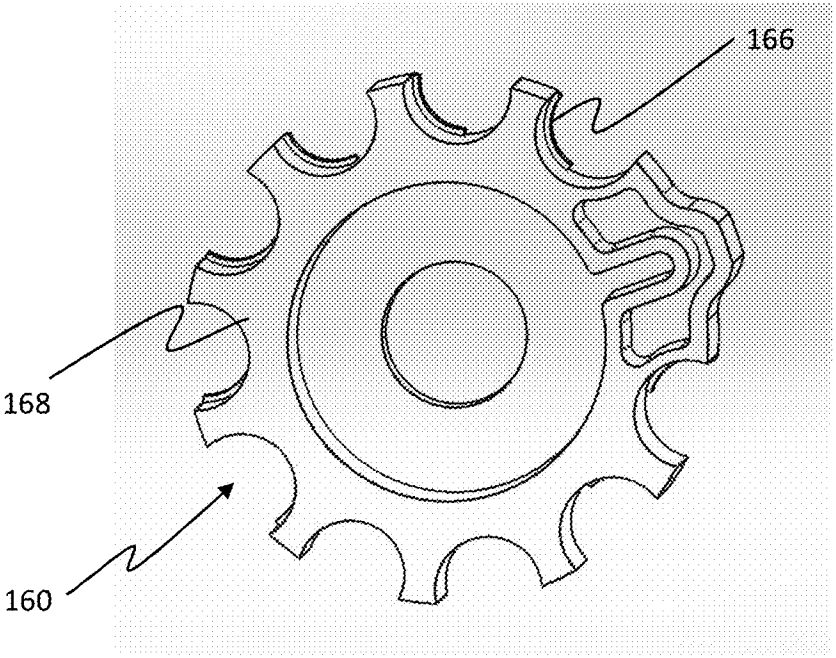
FIG. 15 shows an enlarged view of an alternative embodiment of a carousel and projectile positioners.

FIG. 15 shows an enlarged view of an alternative embodiment of a carousel 168 and projectile positioners 160 using a block 166 of a semi-circular configuration.

In embodiments, any or all of bolt wall 120, a breech wall 140 and a storage wall 150 may comprise generally solid structures as shown or any of these may be formed using for example, example meshes, perforated structures, corrugated materials or shaped or framed fibers that can be reliably positioned in a breach of an airgun to allow operation of the projectile carrier 100 as described herein.

The invention has been described in detail with particular reference to certain preferred embodiments thereof, but it will be understood that variations and modifications can be effected within the spirit and scope of the invention. For example, and without limitation it will be appreciated that the airgun projectile holders described herein may be used with other types of projectile launchers including but not limited to other mechanical projectile launching systems, fluidic launching systems and electro-magnetic launching systems.

What is claimed is:

1. A projectile carrier comprising:

a frame defining a storage area with a breech opening and a bolt opening aligned with the breech opening along a first axis;

a carousel positioned and rotatable within the storage area;

a plurality of projectile drivers defined within the carousel and biased to move in a first direction within the storage area along a path that passes between the breech opening and the bolt opening; and a stop projecting from the frame and positioned to stop movement of the projectile drivers in the first direction when one of the projectile drivers positions a projectile substantially aligned with the first axis, wherein each projectile driver of the plurality of projectile drivers further comprises a block located between the projectile and the bolt opening with the block extending toward the stop so that a separation between the block and the stop is less than a size necessary for the projectile to move from the one of the projectile drivers through the bolt opening and wherein each projectile driver has a separation offset sized to permit movement of the projectile carrier in a second direction along the path sufficient to permit a bolt to enter projectile driver without moving the projectile from a position determined by the stop.

2. The projectile carrier of claim 1, wherein the block has an arcuate shape that tapers axially from a portion of a projectile driver that applies a bias against the projectile to move the projectile in a first direction along the path.

3. The projectile carrier of claim 1, wherein the block comprises a semi-circular block.

4. The projectile carrier of claim 1, wherein the block extends over less than 20 percent of a perimeter of a projectile driver of the plurality of projectile drivers.

5. The projectile carrier of claim 1, wherein the block comprises multiple nodes.

6. The projectile carrier of claim 1, wherein the block has a semi-circular configuration.

7. The projectile carrier of claim 1, wherein the block has a tapered edge confronting the bolt opening, with the tapered edge being configured so that a force applied on an axis generally parallel to the first axis and against a taper of the tapered edge urges the projectile carrier at the bolt opening to move in a second direction to an extent sufficient to allow a bolt to enter a projectile driver defined by the plurality of projectile drivers to advance a projectile in the projectile carrier from the projectile carrier through the breech opening.

8. A projectile carrier comprising a frame defining a storage area with a breech opening and a bolt opening aligned with the breech opening along a first axis;

a carousel positioned and rotatable within the storage area; and a plurality of projectile drivers defined within the carousel each having a portion of a length along the first axis with a leading surface and a trailing surface that is biased to drive a projectile located between the leading surface and trailing surface in a first direction along a path that passes between the breech opening and the bolt opening and a bolt portion to a stop projecting from the frame that positions the projectile for movement along the first axis and each having a bolt passageway portion that is substantially similar in size to that of the projectile at a bolt passageway offset from the first axis when the projectile is positioned between the stop and the trailing surface, wherein the leading surface and the trailing surface are separated by a separation offset in the portion that is greater than the bolt passageway offset so that the projectile carrier can be moved in a second direction along the path to align the bolt passageway with the first axis without causing the projectile drivers to move the projectile from the stop.

9. The projectile carrier of claim 8, wherein the bolt passageway has a tapered edge confronting the bolt opening, with the tapered edge being configured so that a force applied on an axis generally parallel to the first axis and against a taper defined by the tapered edge urges the projectile carrier to move in a second direction to an extent sufficient to allow a bolt to enter the portion to advance a projectile in the projectile carrier from the projectile carrier through the breech opening.

10. The projectile carrier of claim 8, wherein the bolt passageway has an arcuate blocking edge that tapers axially from a portion of a projectile driver that applies a bias against the projectile to move the projectile in a first direction along the path.

11. The projectile carrier of claim 8, wherein the bolt passageway further comprises a semi-circular blocking edge.

12. The projectile carrier of claim 8, wherein the bolt passageway has a blocking edge extends over less than 20 percent of a perimeter of a projectile driver of the plurality of projectile drivers.

13. The projectile carrier of claim 8, wherein the bolt passageway has a blocking edge comprising multiple nodes.

14. The projectile carrier of claim 8, the bolt passageway has a blocking edge that has a semi-circular configuration.

* * * * *